US006412206B1

(12) United States Patent
Strayer

(10) Patent No.: US 6,412,206 B1
(45) Date of Patent: Jul. 2, 2002

(54) SEAR AND SEAR SPRING ASSEMBLY FOR SEMIAUTOMATIC HANDGUNS

(76) Inventor: Sandy L. Strayer, 7409 Boca Raton, North Richland Hills, TX (US) 76180

( * ) Notice: Subject to any disclaimer, the term of this patent is extended or adjusted under 35 U.S.C. 154(b) by 0 days.

(21) Appl. No.: 09/493,321

(22) Filed: Jan. 28, 2000

Related U.S. Application Data

(60) Provisional application No. 60/117,646, filed on Jan. 28, 1999.

(51) Int. Cl.[7] ..... F41A 3/00
(52) U.S. Cl. ..... 42/69.03
(58) Field of Search ..... 42/69.03, 69.01

(56) References Cited

U.S. PATENT DOCUMENTS 4,035,943 A * 7/1977 Civolani et al. ..... 42/69
4,067,131 A * 1/1978 Ruger et al. ..... 42/65
4,361,975 A * 12/1982 Wilhelm ..... 42/69
4,691,461 A * 9/1987 Behlert ..... 42/69.01
4,754,567 A * 7/1988 Lehfeldt et al. ..... 42/69.02
4,908,970 A * 3/1990 Bell ..... 42/69.02
5,299,374 A * 4/1994 Mathys ..... 42/69.01

* cited by examiner

*Primary Examiner*—Charles T. Jordan
*Assistant Examiner*—Denise J Buckley
(74) *Attorney, Agent, or Firm*—Andrews, Kurth, Mayor, Day & Caldwell, L.L.P.

(57) ABSTRACT

A friction minimizing element such as a smooth hardened ball, a dimple in the sear spring (steel, stainless, plastic, carbon fiber or titanium material) is employed to minimize sliding friction between the spring and the disconnector or between other sliding components of a firearm mechanism, particularly the trigger mechanism of a handgun or other firearm. In addition, the same technology can be applied to the trigger bow of a semi-automatic handgun by placing an additional ball or dimple in the trigger bow that minimizes sliding friction between the rear transverse element of the trigger bow and the disconnector of the trigger mechanism. The benefits of the sear spring or the trigger bow modifications can be applied together or separately in the trigger mechanism. Each adds an individual benefit of minimizing sliding friction between engaging trigger components and thus preventing trigger creep as the trigger mechanism is actuated.

14 Claims, 3 Drawing Sheets

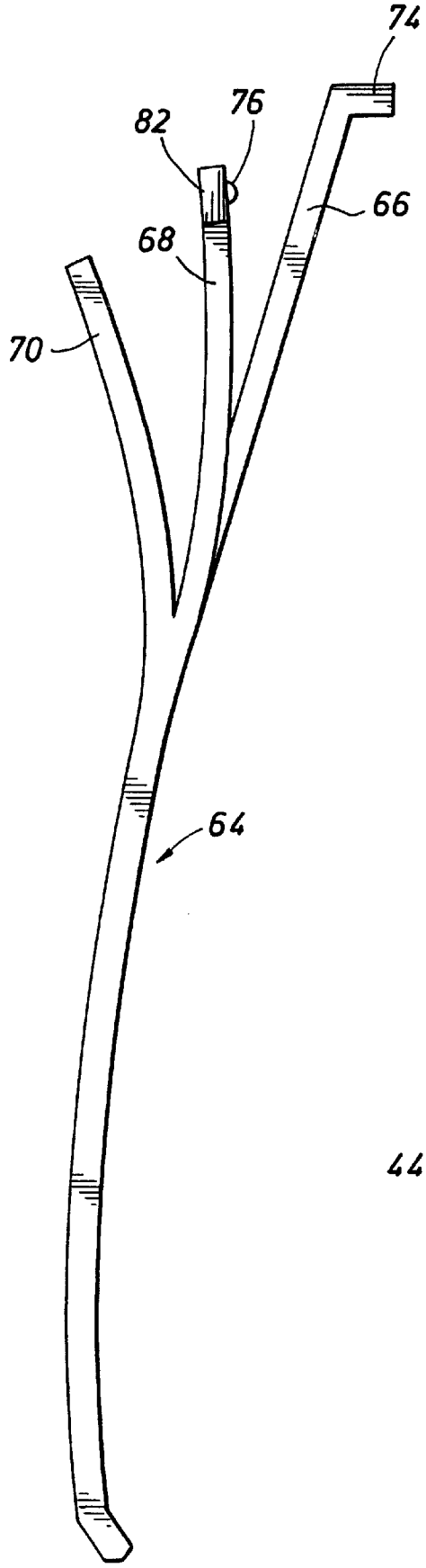
FIG. 4
FIG. 5
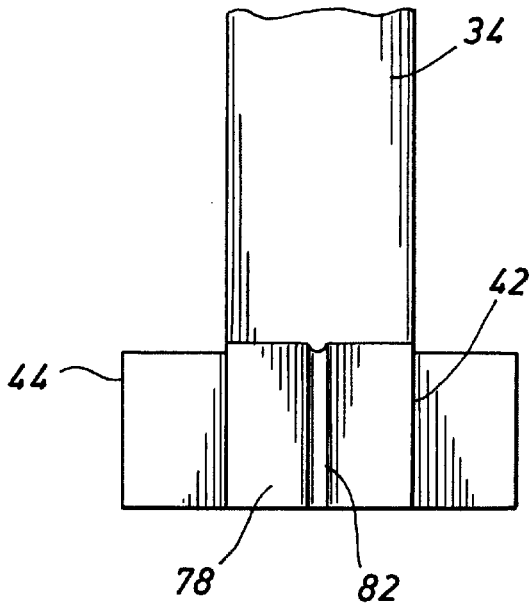

SEAR AND SEAR SPRING ASSEMBLY FOR SEMIAUTOMATIC HANDGUNS

The benefit of United States Provisional Application Serial No. 60/117,646 filed on Jan. 28, 1999 by Sandy L. Strayer and entitled Trigger, Sear and Sear Spring Assembly For Semiautomatic Handguns is hereby claimed and such Provisional Application is incorporated herein by reference for all purposes.

BACKGROUND OF THE INVENTION

1. Field of the Invention

This invention relates generally to semi-automatic handguns of the type generally referred to as the 1911A1 Government Model Handgun, which for many years has been manufactured for and utilized by military and law enforcement agencies of the United States and have also been widely available for civilian use. More specifically, the present invention concerns improvements to the basic 1911A1 Government Model Handgun to enhance the accuracy thereof for utilization of such handguns in match type shooting activities. Even more specifically, the present invention concerns imposition of one or more friction minimizing elements, such as hard metal balls projections formed by dimpling sheet metal or by any other suitable means, which establish contact points between movable handgun actuation components, particular trigger mechanisms to permit low friction, extremely smooth movement and enhancing shooting accuracy.

2. Description of the Prior Art

In a conventional 1911A1 Government Model Handgun, a trigger assembly is disposed in sliding relation within internal slots defined within the handgun frame and is provided with a trigger shoe which extends through a trigger slot of the frame so that a finger engaging portion of the trigger shoe is positioned within the trigger guard of the frame for actuation by a user's finger during firing or discharging actuation of the handgun mechanism. The sliding relation of the trigger assembly with the internal trigger slots of the frame is achieved by a trigger bow having two parallel side elements which engage within the internal trigger slots and a transverse rear bow element which is integral with the parallel side elements and which is engaged by a disconnector element and a leaf type main spring or sear spring. When the trigger mechanism of the handgun is actuated the friction that is developed between sliding components, particularly the main spring and the trigger bow with the disconnector element. causes a condition known as trigger creep, which is an uneven movement of the trigger as the sear is moved to disengage from a shoulder of the hammer. Because of this uneven trigger movement many users of firearms, including handguns, rifles, shotguns and the like, tend to become unsteady during aiming, resulting in inaccurate shooting. It is desirable therefore to provide means for minimizing sliding friction between trigger components and other relatively movable sliding components so that trigger creep does not occur during trigger actuation.

The use of titanium as the spring material for any trigger group—albeit pistols, rifles, shotguns, with the reduced modulus of elasticity of 15 ksi from steel (30 ksi) allows for a broader sweet spot for smoother and more linear trigger pulls. It has always been beneficial to provide a smooth even force of trigger movement from beginning to end. Accuracy is improved with reduced potential for trigger jerk. The movement of the trigger shoe rearward can be divided into three distinct components. The initial movement (commonly referred to as "take-up") of the trigger should be at as close to the same tension from beginning to end where contact is made between the disconnector and the sear. This movement is required to allow clearance for disconnector function to prohibit triggering of the firearm with out the bolt or slide in final position for firing and also to allow reset of the disconnector and the sear after tripping. The mid section of movement is the actual tripping of the sear, resulting with the hammer falling onto the primer or firing pin. The final movement is the continued travel after the hammer is tripped (commonly referred to as over travel). This final movement allows for the clearance between the sear tip and the rotating or sliding hammer geometry. Once the finger releases the trigger shoe the trigger bow/shoe combination is urged rapidly forward by the titanium spring at a very lively linear rate to allow for quick reset of the sear tip and full cock notch of the hammer. The cycle time from initial tripping of the hammer to reset is typically less than 0.06 seconds. Continued movement forward allows for the release of the disconnector to move upward and reset in the disconnector tip notch in the slide. The cycle is now ready to begin again.

SUMMARY OF THE INVENTION

It is a principal feature of the present invention to establish essentially point or linear bearing engagement between relatively movable engaging firearm components, such as the components of trigger mechanisms for handguns, rifles, shotguns and the like, for the purpose of mining friction between the components and thus providing for smooth engaged movement of the components for enhancing the accuracy of the firearm;

It is another feature of the present invention to establish essentially point or line engagement between relatively movable engaging firearm components by utilizing small projections on such components to maintain contact therebetween as relative movement occurs between components;

It is an even further feature of the present invention to establish essentially point or line engagement between relatively movable engaging firearm components by interposing small, relatively hard and smooth elements, such as metal balls, dimples formed in metal structure and projections defined by metal structure so that the hard and smooth small elements permit engaged low friction relative sliding movement to be accomplished by such components so that the components will not tend to creep as such movement occurs.

Briefly, this invention is based on the insertion of a smooth hardened ball, a dimple in the sear spring (steel, stainless, plastic, carbon fiber or titanium material) to minimize sliding friction between the spring and the disconnector or between other sliding components of a firearm mechanism, particularly the trigger mechanism of a handgun or other firearm. In addition, the same technology can be applied to the trigger bow of a semi-automatic handgun by placing an additional ball or dimple in the trigger bow that minimizes sliding friction between the rear transverse element of the trigger bow and the disconnector. The benefits of the sear spring or the trigger bow modifications can be applied together or separately in the trigger mechanism. Each adds an individual benefit of minimizing sliding friction between engaging trigger components. Together the effect is synergistic and provides for extremely smooth operation of the disconnector and thus smooth operation of the trigger mechanism. A matching cylindrical groove can also be placed in the disconnector where the balls or dimples would run thus creating a linear bearing surface rather than point contact that provides minimized friction and alignment of the trigger to the disconnector and the sear spring to the disconnector.

To minimize friction in the trigger mechanism of a 1911 A1 Government Model semi-automatic handgun or a similar firearm, a hard metal, typically chrome steel ball is mounted to one trigger assembly component and establishes point contact or minimal surface area contact with another trigger assembly component. In the 1911 A1 Government Model semi-automatic handgun, one of the three prongs of the sear spring engages a transverse end member of a trigger bow. A transversely bent upper portion of one of the prongs of a three pronged sear spring overlies and captures the end member of the trigger bow in interlocking relation so that the sear,and trigger bow are mechanically interconnected.

A central prong of the three-pronged main spring is provided with an enlarged upper portion which is split and defines a ball seat. A hard chrome steel ball member is seated in the ball seat so that a low friction, essentially point contact relation is established between the transverse rear portion of the trigger bow and the main or sear spring. This condition lessens or eliminates potential "creep" of the trigger during firing so that a crisp hammer release occurs, thereby enhancing the accuracy of shooting activities. Alternatively, the hard metal ball may be set into a ball seat that is defined in the transverse rear end member of the trigger bow so that point contact is established between the ball and the upper end of the central prong of a conventional sear spring. Other engaging trigger components may also be equipped with a contact ball, a projection formed by a dimple or formed by any other method, for similar purposes.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevational view showing a 1911A1 Government Model type semi-automatic handgun constructed according to the principles of the present invention;

FIG. 2 is an isometric view showing a trigger bow, sear spring and disconnector of the handgun mechanism of FIG. 1, which embody the principles of the present invention and show the presence of friction minimizing projections in the trigger bow and sear spring;

Figure 3:
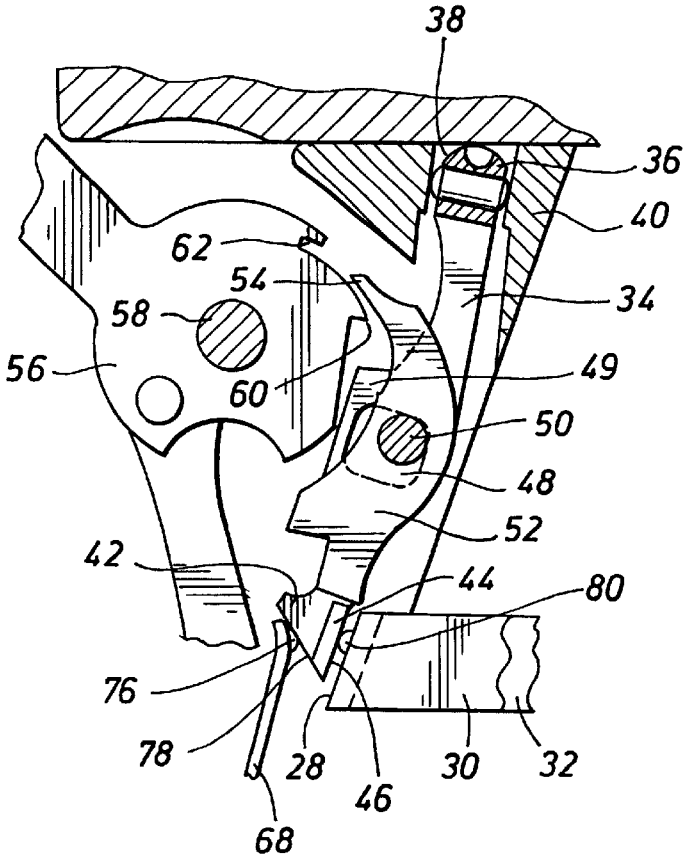

FIG. 3 is an elevational view identifying the relationships of the components of the trigger mechanism of the handgun and showing a trigger assembly including a hammer, sear, sear spring disconnector and trigger bow, with friction minimizing elements establishing contact between the sear spring and disconnector and between the trigger bow and disconnector according to the principles of the present invention;

FIG. 4 is a side elevational view showing a mainspring embodying the principles of the present invention and illustrating the geometry of the three spring tines thereof; and FIG. 5 is a partial elevational view showing the lower end of a disconnector element that is modified to show a tracking groove for a friction minimizing element being formed in the inclined engaging surface portion of the disconnector.

DETAILED DESCRIPTION OF PREFERRED EMBODIMENT

Figure 1:
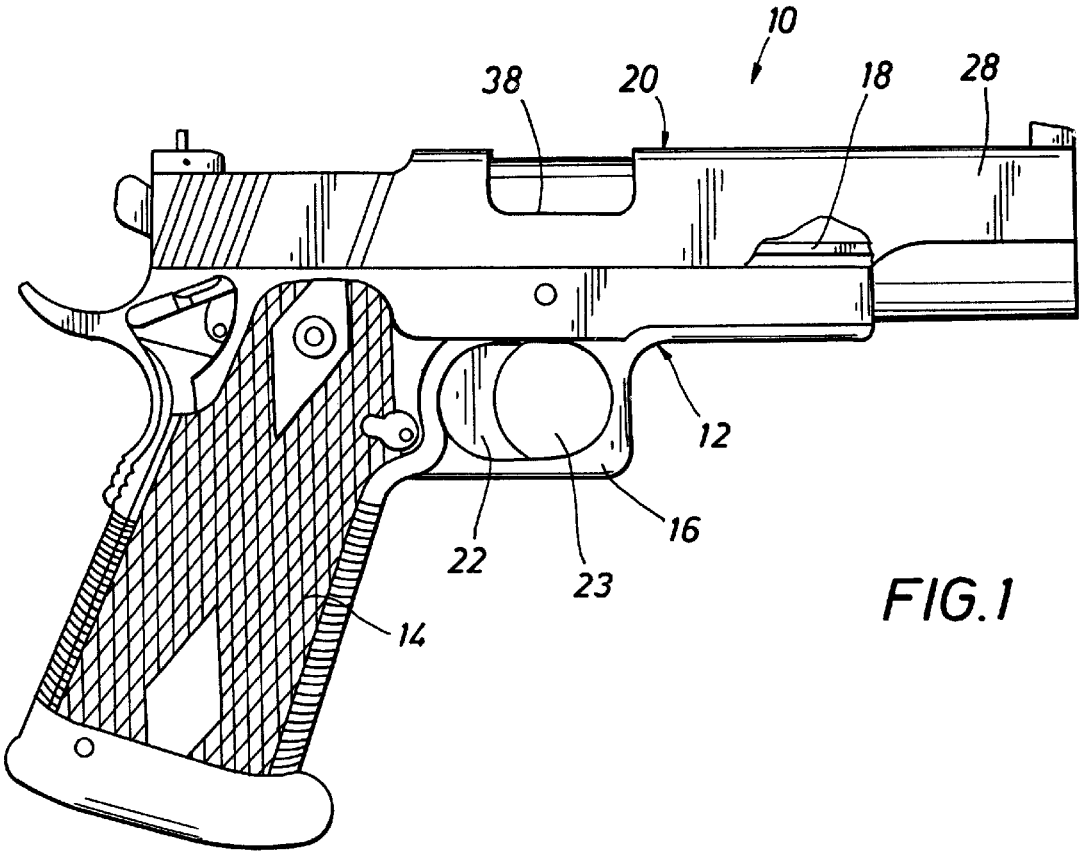

Referring now to the drawings and first to FIG. 1, a 191A1 Government Model type handgun, which is manufactured according to the principles of the present invention and represents the preferred embodiment of the invention, is shown generally at 10 and comprises a frame structure shown generally at 12 having a handgrip 14 and a trigger guard 16. The upper portion of the frame structure defines guide rails, a portion of which being shown at 18. A slide assembly, shown generally at 20 defines internal opposed guide grooves which receive the guide rails 18 and establish a guided reciprocating relation between the slide assembly and the frame of the handgun. The slide assembly 20 is generally constructed according to the principles of a conventional 1911A1 Government Model type handgun and generally incorporates the internal mechanically operable components thereof.

The handgun frame 12 defines a trigger slot opening to the trigger guard 16 and a trigger assembly is movably located within the handgun frame and incorporates a trigger shoe 22 which extends through the trigger slot opening so that a finger engaging part of the trigger shoe is positioned within the trigger guard opening 23 for actuating contact by a finger of a user of the handgun. The trigger shoe is affixed or attached to a trigger bow, shown generally at 24 in FIG. 2. The trigger bow 24 defines front and rear transverse bow sections 26 and 28 which are integral with generally parallel trigger guide elements 30 and 32. The parallel trigger guide elements 30 and 32 are linearly movable within opposed internal trigger guide slots defined within the handgun frame 12. As shown in FIG. 3, the rear transverse bow section 28 is oriented in inclined relation with respect to the trigger guide elements 30 and 32.

A disconnector 34 is movable within an internal cavity of the frame 12 and is positioned with its upper end section 36 located within a receptacle defined within the frame structure 12. The lower end 42 of the disconnector defines a trigger bow engaging section 44 defining a trigger bow engaging surface 46. The trigger bow engaging section also defines lateral flanges 45 and 47 as best shown in FIG. 5, and which are provided for actuation of the sear upon movement of the disconnector by the trigger bow. In conventional 1911A1 Government Model semi-automatic handguns, the disconnector establishes "surface to surface" sliding contact with the rear transverse trigger bow section 28, developing frictional resistance to movement of the trigger mechanism. This frictional resistance develops what is generally referred to as trigger creep which prevents smooth movement of the trigger mechanism during firing of the handgun. This is especially critical during match type shooting activities where extreme accuracy is needed. The central portion 49 of the disconnector defines a typically rectangular opening 48 which receives a sear pin 50 so that the disconnector has a wide range of movement relative to the sear pin, but is secured by the sear pin so that it can be maintained in contact with other trigger components for operational control of various aspects of the trigger mechanism.

A sear element 52 is mounted for rotation within the internal cavity of the frame by the sear pin 50 and is provided with a thin hammer release end 54 which is adapted for engagement with controlling shoulders of a hammer element 56 which is mounted for rotation within the internal cavity of the frame by a trigger pin 58 which is located within openings of the frame. At the full cock position of the trigger 56, the thin hammer release end 54 is disposed in restraining engagement with the trigger shoulder 60 while at the half cock position of the trigger the thin hammer release end 54 is engaged within a safety groove 62 in a manner that will not permit disengagement of the sear from the trigger and thus will not permit the handgun to be fired by application of manual force to the trigger shoe 22. At the full cock position of the trigger 56 application of manual force to the trigger shoe forces the trigger bow against the lower end of the disconnector and through the disconnector, actuates the sear, causing it to rotate clockwise as shown in FIG. 3 for releasing the end 54 from the trigger shoulder 60.

Figure 2:
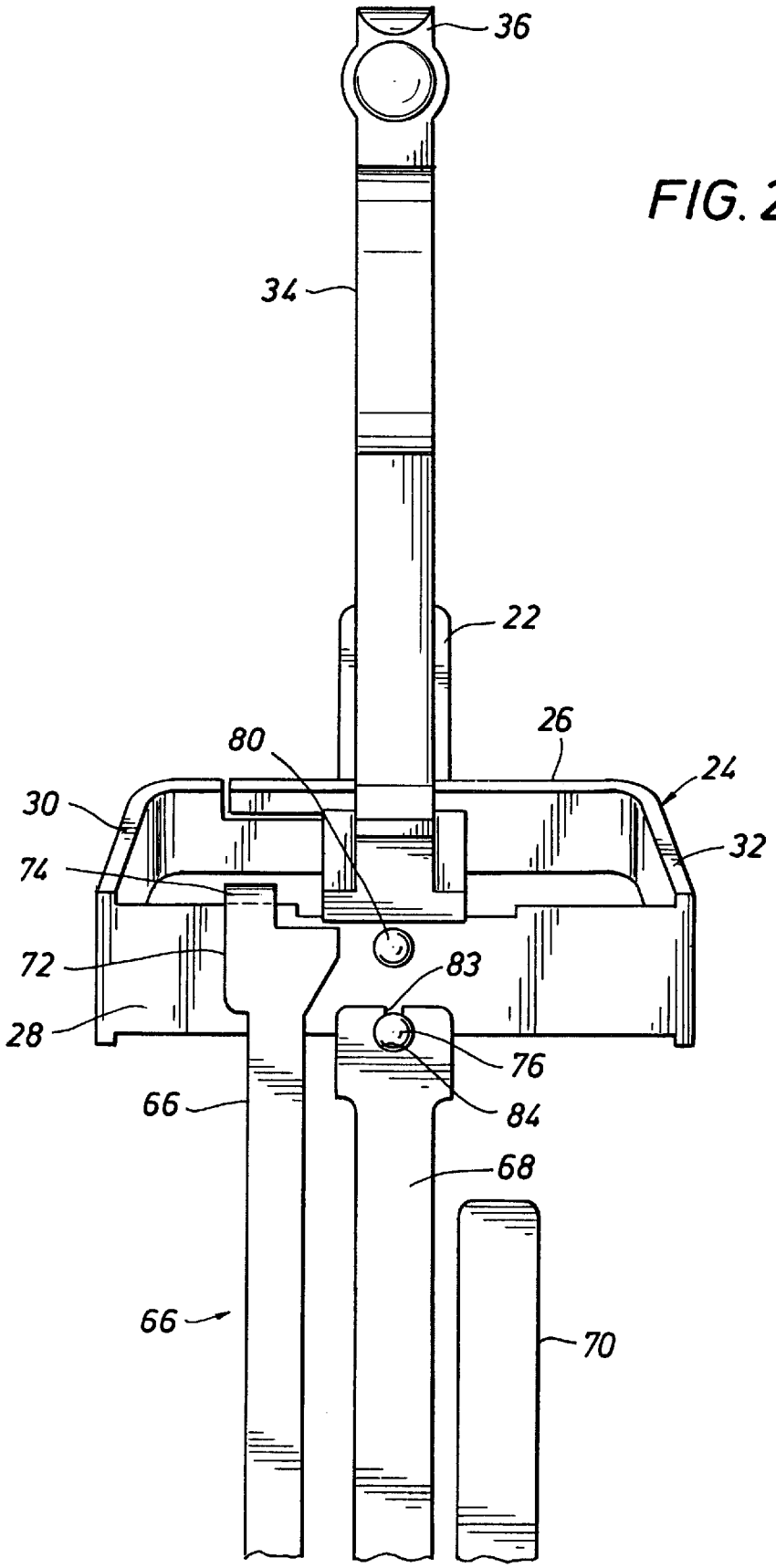

A mainspring, also referred to as a sear spring, is provided, as shown generally at 64 in FIGS. 2 and 4, and has three spring tines 66, 68 and 70. Spring tine 66 applies forward force to the trigger bow and defines an upper end section 72 which engages the rear transverse section 28 of the trigger bow. The spring tine 66 further defines a bent upper section 74 which overlies the upper edge of the rear transverse section of the trigger bow and provides for vertical location of the main spring relative to the trigger bow. The central spring tine 68, as shown particularly in FIG. 3, is provided with a friction minimizing projection 76 which is positioned for sliding contact with a generally planar tapered surface 78 that is defined by the lower end of the disconnector 34. Another friction minimizing projection 80 is shown to be supported by the rear transverse element 28 of the trigger bow and disposed for sliding engagement with the generally planar surface 46 of the disconnector 34. It should be borne in mind that the friction minimizing projections 76 and 80 may be used at the same time or either of them may be used independently to enhance smoothness of trigger movement by minimizing trigger creep. Although a hard metal friction minimizing ball may be fixed to a metal element in any suitable manner, as shown in FIG. 2 the central prong or tine 68 of the main spring 64 is shown to be retained within a ball seat 83 formed in an enlarged upper end section 82. To define the ball seat, an opening 84 slightly smaller than the diameter of the ball type projection 80 is formed in the upper end section of the central spring tine. The metal from the ball seat opening 84 to the upper edge of the central spring tine 68 is then split as shown at 85. The ball type friction minimizing element 80 is then pressed into the ball seat opening 84 where it is retained by the metal structure of the central tine of the main spring. When the ball is press fitted within its ball seat opening, the split 85 in the enlarged spring tine section will widen slightly. The ball will be retained sufficiently tight within its ball seat opening that it will not be displaced from its seat by the usual forces that are experienced by trigger components during firing of the handgun mechanism. The ball projects sufficiently from the central spring tine or from any component in which it is seated so that only the ball will contact the disconnector or other trigger component, thus significantly minimizing surface area contact between the components.

As mentioned above, and as shown in FIG. 5, the lower end 42 of the disconnector element 34 defines an inclined, substantially planar surface 78. This planar surface may be machined to define a substantially straight ball track groove within which the friction minimizing ball 76 is received. As the spring tine 68 and the disconnector surface slide one relative to the other, the ball 76 will remain within the ball track groove, thus providing for a guiding or centering relationship to ensure that the components remain accurately aligned during relative sliding movement.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. In a firearm trigger mechanism for a semi-automatic handgun having a trigger bow being in relatively movable relation with a main spring and being disposed for sliding relatively movable relation therewith, the improvement comprising:

at least one friction minimizing element projecting from at least one of said trigger bow and said main spring and having sliding engagement with the other of said trigger bow and said main spring to minimize frictional resistance to movement thereof.

2. The improvement of claim 1, comprising:

(a) a ball seat being defined by at least one of said trigger bow and said main spring; and (b) said at least one friction minimizing element being a spherical element composed of hardened metal and being retained within said ball seat with a portion thereof projecting beyond said said at least one of said trigger bow and said main spring and being in sliding contact with the other of said at least one of said trigger bow and said mainspring.

3. The improvement of claim 2, comprising:

(a) said ball seat being a circular opening in said first sliding component having an internal diameter smaller that the diameter of said spherical element for receiving said spherical element by press fit; and (b) a cut being defined in said first sliding component and intersecting said circular opening and permitting expansion of said circular opening by said spherical element during press fit installation thereof.

4. The improvement of claim 1, comprising:

said at least one friction minimizing element being a projection extending from said first sliding component and having substantially point contact with said second sliding component.

5. In a firearm trigger mechanism having relatively movable first and second trigger components disposed for sliding relatively movable relation, the improvement comprising:

(a) at least one spherical friction minimizing element being composed of hardened metal and projecting from said first sliding component and having sliding engagement with said second sliding component;

(b) a ball seat being a circular opening in said first sliding component and having an internal diameter smaller that the diameter of said spherical element for receiving said spherical element by press fit; and (a) a cut being defined in said first sliding component and intersecting said circular opening and permitting expansion of said circular opening by said spherical element during press fit installation thereof.

6. The improvement of claim 5, comprising:

(a) said first sliding component being a transverse structural element of a trigger bow; and (b) said second sliding component being a trigger bow engaging portion of a disconnector element.

7. The improvement of claim 5, comprising:

(a) said first sliding component being a spring tine of a main spring element; and (b) said second sliding component being a main spring engaging portion of a disconnector element.

8. The improvement of claim 5, comprising:

said projection defined by said at least one friction minimizing element being defined by a dimple in said first sliding component.

9. A trigger actuating mechanism for a firearm, comprising:

(a) a trigger being manually movable relative to a firearm frame;

(b) a disconnector being movably supported within the firearm frame and having a portion thereof in sliding engagement with said trigger;

(c) a spring having force transmitting relation with said disconnector and with said trigger;

(d) a friction minimizing element being interposed between said trigger and said disconnector and establishing said sliding engagement of said disconnector with said trigger; and;

(e) a circular seat opening in said trigger and having an internal diameter smaller than said friction minimizing element for receiving said friction minimizing element by press fit.

10. The trigger actuating mechanism of claim 9, comprising:

said friction minimizing element being a spherical element composed of hardened metal and being retained within said circular seat opening with a portion thereof projecting beyond said trigger and being in sliding contact with said disconnector.

11. The trigger actuating mechanism of claim 10, comprising:

(a) said ball seat opening in said trigger having an internal diameter smaller that the diameter of said spherical element for receiving said spherical element by press fit; and (b) a cut being defined in said trigger and intersecting said circular opening and permitting expansion of said circular opening by said spherical element during press fit installation thereof.

12. The trigger actuating mechanism of claim 9, comprising:

(a) a ball seat being defined by said spring;

(b) said at least one friction minimizing element being a spherical element composed of hardened metal and being retained within said ball seat with a portion thereof projecting beyond said spring and being in sliding contact with said disconnector;

(c) a second ball seat being defined by said trigger; and (d) a second spherical element being retained within said second ball seat with a portion thereof projecting beyond said trigger and having sliding engagement with said disconnector.

13. The trigger actuating mechanism of claim 9, comprising:

(a) a ball seat being defined by said spring; and (b) said at least one friction minimizing element being a spherical element composed of hardened metal and being retained within said ball seat with a portion thereof projecting beyond said spring and being in sliding contact with said disconnector.

14. The trigger actuating mechanism of claim 13, comprising:

(a) said ball seat being a circular opening in said trigger having an internal diameter smaller that the diameter of said spherical element for receiving said spherical element by press fit; and (b) a cut being defined in said spring and intersecting said circular opening and permitting expansion of said circular opening by said spherical element during press fit installation thereof.

* * * * *

UNITED STATES PATENT AND TRADEMARK OFFICE

CERTIFICATE OF CORRECTION

PATENT NO. : 6,412,206 B1
DATED : July 2, 2002
INVENTOR(S) : Strayer

It is certified that error appears in the above-identified patent and that said Letters Patent is hereby corrected as shown below:

Column 3,
Line 15, delete “sear,and”, insert -- sear, and --
Line 59, after the word “spring” insert -- ; --

Column 4,
Line 8, delete “191A1”, insert -- 1911A1 --,

Column 6,
Line 37, delete second occurrence “said”
Line 39, delete “mainspring”, insert -- main spring --
Line 63, delete “that”, insert -- than --
Line 66, delete “(a)”, insert -- (c) --

Column 7,
Line 31, delete “and;”, insert -- and --

Column 8,
Line 2, delete “that”, insert -- than --

Signed and Sealed this

Thirty-first Day of December, 2002

JAMES E. ROGAN
*Director of the United States Patent and Trademark Office*